US007633463B2

(12) United States Patent
Negru

(10) Patent No.: US 7,633,463 B2
(45) Date of Patent: Dec. 15, 2009

(54) METHOD AND IC DRIVER FOR SERIES CONNECTED R, G, B LEDS

(75) Inventor: Sorin Laurentiu Negru, San Jose, CA (US)

(73) Assignee: Analog Devices, Inc., Norwood, MA (US)

( * ) Notice: Subject to any disclaimer, the term of this patent is extended or adjusted under 35 U.S.C. 154(b) by 561 days.

(21) Appl. No.: 11/116,724

(22) Filed: Apr. 28, 2005

(65) Prior Publication Data

US 2005/0243022 A1 Nov. 3, 2005

Related U.S. Application Data

(60) Provisional application No. 60/567,343, filed on Apr. 30, 2004.

(51) Int. Cl.
*G09G 3/14* (2006.01)

(52) U.S. Cl. ..... 345/46; 315/169.1; 345/102

(58) Field of Classification Search ..... 345/39, 345/46, 76–83, 211–213, 690–693; 315/169.1, 315/169.3; 362/555
See application file for complete search history.

(56) References Cited

U.S. PATENT DOCUMENTS 4,689,740 A * 8/1987 Moelands et al. ..... 713/600
5,742,133 A 4/1998 Wilhelm
5,844,540 A * 12/1998 Terasaki ..... 345/102
5,966,110 A 10/1999 Van Zalinge
6,144,222 A 11/2000 Ho
6,208,073 B1 3/2001 Wang et al.
6,348,818 B1 2/2002 Filipovski
6,362,578 B1 3/2002 Swanson
6,400,101 B1 6/2002 Biebl
6,411,531 B1 * 6/2002 Nork et al. ..... 363/60
6,486,726 B1 11/2002 Worley, Sr.
6,515,434 B1 2/2003 Biebl
6,586,890 B2 7/2003 Min
6,603,342 B2 8/2003 Liao et al.
6,680,834 B2 1/2004 Williams
6,741,351 B2 5/2004 Marshall
6,798,517 B2 9/2004 Wagner et al.

(Continued)

OTHER PUBLICATIONS

Lighting Management Solutions for Ultra-Portable Applications, Lit. No. 6000802-001, © 2003 Fairchild Semiconductor.

(Continued)

*Primary Examiner*—Alexander Eisen
*Assistant Examiner*—Kenneth B Lee, Jr.
(74) *Attorney, Agent, or Firm*—Goodwin Procter LLP

(57) ABSTRACT

A LED driver is connectible to several series connected RGB LEDs which connect in series with a current generator. A plurality of LED switches are respectively connectible across one RGB LED. Each LED switch, operating in response to a binary signal is either open to permit electrical current to flow through the RGB LED, or closed to shunt current around that RGB LED. By varying respective duty cycles of the binary signals the LED driver is adapted for controlling operation of the combined RGB LEDs so they emit differing colors of light. An adaptive boost converter LED driver continuously adjusts voltage applied across the series connected RGB LEDs to be only that required for operating those LEDs through which open LED switches permit current to flow.

11 Claims, 5 Drawing Sheets

U.S. PATENT DOCUMENTS

| | | | | |
|---|---|---|---|---|
| 2001/0022495 | A1 | 9/2001 | Salam | |
| 2001/0033503 | A1* | 10/2001 | Hamp et al. | 363/73 |
| 2002/0036778 | A1 | 3/2002 | Wagner et al. | |
| 2002/0109605 | A1 | 8/2002 | Liu | |
| 2002/0130786 | A1* | 9/2002 | Weindorf | 340/815.45 |
| 2002/0149892 | A1 | 10/2002 | Williams | |
| 2002/0171467 | A1 | 11/2002 | Worley, Sr. et al. | |
| 2003/0025465 | A1 | 2/2003 | Swanson et al. | |
| 2003/0030808 | A1 | 2/2003 | Marshall et al. | |
| 2003/0057883 | A1 | 3/2003 | Liao et al. | |
| 2003/0102819 | A1 | 6/2003 | Min et al. | |
| 2003/0112229 | A1 | 6/2003 | Pong et al. | |
| 2003/0122502 | A1 | 7/2003 | Clauberg et al. | |
| 2004/0036424 | A1 | 2/2004 | Hsieh | |
| 2004/0041620 | A1 | 3/2004 | D'Angelo et al. | |
| 2004/0090403 | A1* | 5/2004 | Huang | 345/82 |
| 2004/0165379 | A1 | 8/2004 | Waters | |
| 2004/0217932 | A1 | 11/2004 | Nally et al. | |
| 2004/0245946 | A1* | 12/2004 | Halter | 315/312 |
| 2004/0256625 | A1* | 12/2004 | Russell et al. | 257/80 |
| 2005/0007085 | A1* | 1/2005 | Murakami | 323/282 |
| 2005/0023537 | A1 | 2/2005 | Salam | |
| 2007/0046485 | A1* | 3/2007 | Grootes et al. | 340/815.45 |

OTHER PUBLICATIONS

Allegro Microsystems, Data Sheet 6275: 8-bit serial input, constant-current latched LED driver (www.allegromicro.com) (downloaded May 2004).

Allegro Microsystems, Data Sheet 6276: 16-bit serial input constant-current latched LED driver (www.allegromicro.com) (downloaded May 2004).

Linear Technology Corp., Data Sheet LTC3205: Multidisplay LED controller (Aug. 2003).

National Semiconductor Corp., Data Sheet LP3933: Lighting management system for six white LEDs and two RGB or flash LEDs (2004).

National Semiconductor Corp., Data Sheet LP3936: Lighting management system for six white LEDS and one RGB or flash LED (2003).

Maxim Integrated Products, Data Sheet MAX6956: 2-wire interfaced, 2.5V to 5.5V, 20-port or 28-port LED display driver and I/O expander (Rev. Nov. 2, 2003).

Maxim Integrated Products, Data Sheet MAX6957, 4-wire-interfaced, 2.5V to 5.5V, 20-port and 28-port LED display driver and I/O expander (Rev. Oct. 3, 2003).

New Japan Radio Co. Ltd., Data Sheet NJU6060: Full color LED controller driver with PWM control (Apr. 2004).

New Japan Radio Co. Ltd., Data Sheet NJU6061: Full color LED controller driver with PWM control (Mar. 2004).

ON Semiconductor, Data Sheet NLSF595: Serial (SPI) tri-color LED driver (May 2003).

Rohm Electronics (UK) Ltd., Data Sheet: White LED driver BH6040FVM and tri-colour LED driver BH8770FVM (www.rohm.co.uk) (downloaded May 2004).

Philips Semiconductors, Integrated Circuits Data Sheet: PCA9530: 2-bit I2C LED dimmer (Dec. 2002).

Philips Semiconductors, Integrated Circuits Data Sheet: PCA9533: 4-bit I2C LED dimmer (Sep. 2003).

* cited by examiner

METHOD AND IC DRIVER FOR SERIES CONNECTED R, G, B LEDS

CLAIM OF PROVISIONAL APPLICATION RIGHTS

This application claims the benefit of U.S. Provisional Patent Application No. 60/567,343 filed on Apr. 30, 2004.

BACKGROUND

1. Technical Field

The present disclosure relates generally to electronic circuits for controlled energizing of light emitting diodes ("LEDs"), and more specifically for such circuits for controlled energizing of series connected red, green, blue ("RGB") LEDs.

2. Description of the Prior Art

One of the most important functions in various portable devices such as personal digital assistants ("PDAs"), cell phones, digital still cameras, camcorders, etc. is displaying to a user the device's present condition, i.e. a display function. Without a display function, a device's user could not enter data into or retrieve data from the device, i.e. control the device's operation. Thus, a portable device's display function is essential to its usefulness.

Devices implement their display function in various different ways, e.g. through a display screen such as a liquid crystal display ("LCD"), through a numeric keypad and/or alphanumeric keyboard and their associated markings, through function keys, through an individual point display such as power-on or device-operating indicator, etc.

Due to space limitations in portable devices, these various different types of display function as well as other ancillary functions are performed largely by white LEDs ("WLEDs") and RGB LEDs. Within portable devices, LEDs provide backlighting for panels such as LCDs, dimming of a keypad, or a flash for taking a picture, etc.

Controlling the operation of WLEDs and RGB LEDs requires using a special driver circuit assembled using discrete components or a dedicated integrated circuit ("IC") controller. For many LEDs connected in various different ways there exists a need for a special driver circuit that provides proper power to the LEDs at minimum cost. What does proper power mean? Proper power means that the special driver circuit must provide voltage and current required so the LEDs emit light independent of the portable device's energy source, e.g. a battery having a voltage ("v") between 1.5v and 4.2v. What does minimum cost means? Minimum cost means that the special driver circuit must energize the LEDs with maximum efficiency thereby extending battery life.

WLED Control

To permit dimming, a WLED must be supplied with a voltage between 3.0v and 4.2v and a current in the milliampere ("mA") range. Typical WLED values for energizing the operation of WLEDs are 3.7v and 20 mA. WLEDs exhibit good matching of threshold voltage due to their physical structure. As illustrated in FIGS. 1 and 2, this particular characteristic of WLEDs is very useful for controller design.

FIG. 1 illustrates one particular configuration for a circuit that energizes the operation of parallel connected WLEDs. In FIG. 1, a battery 52 connects between circuit ground 54 and a power input terminal 56 of a conventional IC LED driver 58. The LED driver 58, which also connects to circuit ground 54, receives electrical power from the battery 52 via the power input terminal 56 for energizing its operation. For the battery polarity depicted in FIG. 1, a LED power output terminal 62 of the LED driver 58 connects in parallel to anodes 64 of several WLEDs 66. Connected in this way the LED power output terminal 62 of the LED driver 58 supplies electrical current to the WLEDs 66 for energizing their operation. To equalize or match the electrical current flowing through each of the WLEDs 66, a cathode 72 of each of the WLEDs 66 connects in series through a ballast resistor 74 to circuit ground 54. Switching the locations of the WLED 66 and the ballast resistor 74 depicted in FIG. 1 produces an electrically equivalent circuit. However, regardless of the particular circuit configuration for energizing parallel connected WLEDs 66, the ballast resistors 74 always waste power. Consequently, circuits such as that depicted in FIG. 1 having WLEDs 66 connected in parallel are an inefficient way to energize operation of WLEDs 66.

FIG. 2 depicts a number of WLEDs 66 connected in series with each other and with a ballast resistor 74. Connection of the WLEDs 66 in series is much more efficient because it limits power loss to that in a single ballast resistor 74. However, the LED power output terminal 62 of the LED driver 58 depicted in FIG. 2 must supply an output voltage that is approximately four (4) times greater than that supplied from the LED power output terminal 62 of the LED driver 58 in FIG. 1.

RGB LED Control

A LED driver 58 for RGB LEDs is slightly more complicated than that for WLEDs 66 because the three colored LEDs have different dimming threshold voltages. For example, the dimming threshold voltage for a red LED 84, such as that illustrated in FIG. 3, is approximately 1.9v, for a blue LED 94 is approximately 3.7v, and for a green LED 104 is approximately 3.7v. Resistances of three (3) ballast resistors 74 connected respectively between cathodes 86, 96 and 106 of the RGB LEDs 84, 94, 104 and circuit ground 54 must be selected accommodate the different dimming threshold voltages of the RGB LEDs 84, 94, 104. Energy dissipated in the ballast resistors 74 means that driving RGB LEDs 84, 94, 104 in parallel leads to a significant power loss.

A series connection for the RGB LEDs 84, 94, 104 illustrated in FIG. 4 reduces power loss. In the typical circuit for series connected RGB LEDs 84, 94, 104 depicted in FIG. 4, an anode 82 of the red LED 84 connects to the LED power output terminal 62 of the LED driver 58. In turn, the cathode 86 of the red LED 84 connects to an anode 92 of the blue LED 94. Similarly, the cathode 96 of the blue LED 94 connects to an anode 102 of the green LED 104. Finally, the cathode 106 of the green LED 104 connects through the ballast resistor 74 to circuit ground 54. While FIG. 4 illustrates a particular order for the RGB LEDs 84, 94, 104, those skilled in the art understand that the series connected RGB LEDs 84, 94, 104 may be arranged in any order.

An essential requirement for a LED driver 58 for RGB LEDs 84, 94, 104 intended for use in portable devices is that it be capable of supplying a specific combination of bias currents to the RGB LEDs 84, 94, 104 so they emit white light. This essential requirement for a LED driver 58 for RGB LEDs 84, 94, 104 is difficult because obtaining white light requires that a different amount of current flow through each of the RGB LEDs 84, 94, 104. The differing current requirement for producing white light from three (3) series connected RGB LEDs 84, 94, 104 prohibits using a series connection with the same current flowing through all three (3) RGB LEDs 84, 94, 104.

BRIEF SUMMARY

An object of the present disclosure is to provide an efficient LED driver for a set of series connected RGB LEDs.

Another object of the present disclosure is to provide an efficient LED driver for producing white light using a set of series connected RGB LEDs.

Another object of the present disclosure is to provide an adaptive boost converter for series connected RGB LEDs which energizes their operation with proper power at minimum cost.

Briefly, one aspect of the present disclosure is a LED driver that is adapted for connecting to a number of series connected RGB LEDs. The series connected RGB LEDs are also connectible in series with a current generator. The LED driver includes a plurality of LED switches which equals in number the number of series connected RGB LEDs. Each individual LED switch included in the LED driver is connectible across one of the RGB LEDs. Each individual LED switch also operates in response to a binary digital switching signal. When the LED switch responsive to the switching signal is open, the LED switch permits electrical current to flow through the RGB LED across which the LED switch is connectible. When the LED switch responsive to the switching signal is closed, the LED switch shorts across the RGB LED across which the LED switch is connectible, and thereby shunts current around that RGB LED. In this way by varying respective duty cycles of the switching signals the LED driver is adapted for controlling operation of the RGB LEDs so that when energized the combined, series connected RGB LEDs emit differing colors of light.

Another aspect of the present disclosure is an adaptive boost converter for supplying electrical current to a number of series connected RGB LEDs for energizing the operation thereof. The series connected RGB LEDs are also connectible in series with a current generator. The adaptive boost converter includes a power input terminal for receiving electrical power from an energy source. The adaptive boost converter also includes a plurality of LED switches which equals in number the number of series connected RGB LEDs. Each individual LED switch included in the LED driver is connectible across one of the RGB LEDs. Each individual LED switch also operates in response to a binary digital switching signal. When the LED switch responsive to the switching signal is open, the LED switch permits electrical current to flow through the RGB LED across which the LED switch is connectible. When the LED switch responsive to the switching signal is closed, the LED switch shorts across the RGB LED across which the LED switch is connectible, and thereby shunts current around that RGB LED. The adaptive boost converter also includes a comparator that is connectible to the current generator for sensing voltage across the current generator. Finally, the adaptive boost converter also includes a voltage boosting circuit for increasing voltage of electrical power received from the energy source to a higher voltage. The adaptive boost converter applies this higher voltage electrical power across the series connectible RGB LEDs and series connectible current generator. Moreover, the voltage applied by the adaptive boost converter across the series connected RGB LEDs and series connectible current generator varies in response to an output signal received by the voltage boosting circuit from the comparator. In this way the voltage applied across the series connectible RGB LEDs and series connectible current generator is only that required by the series connectible RGB LEDs whose operation is then being energized by the adaptive boost converter plus a bias voltage required to ensure proper operation of the current generator.

Yet another aspect of the present disclosure is a LED driver IC adapted for:

1. supplying electrical current to a number of series connected RGB LEDs for energizing operation thereof; and
2. controlling operation of those series connected RGB LEDs.

The LED driver IC includes a power input terminal for receiving electrical power from an energy source, and a plurality of LED switches equal in number to the number of series connected RGB LEDs. Each LED switch:

1. is connectible across one of the RGB LEDs; and
2. operates in response to a binary digital switching signal so that the LED switch:
   a. when open permits electrical current to flow through the RGB LED across which the LED switch is connectible; and
   b. when closed shorts across and thereby shunts current around the RGB LED across which the LED switch is connectible.

The LED switches have a repetition rate which fast enough to avoid ocularly perceptible flicker in light producible by series connected RGB LEDs that are connectible to the LED driver IC.

The LED driver IC also includes a current generator that is connectible in series with series connected RGB LEDs, and a comparator connected to the current generator for:

1. sensing voltage across the current generator; and
2. producing a comparator output signal which responds to the voltage across the current generator.

A boost control circuit, also included in the LED driver IC, receives the comparator output signal from the comparator, and responsive to the comparator output signal generates a digital boost control signal. The digital boost control signal has a frequency significantly higher than the repetition rate of the binary digital switching signals for operating the LED switches.

Lastly, the LED driver IC includes a voltage-boost switch that:

1. receives the boost control signal from the boost control circuit;
2. responsive to the boost control signal repetitively turns on and off at the frequency of the boost control signal.

The voltage-boost switch has a switch output terminal which is connectible to one terminal of an inductor with the inductor being connectible between:

1. series connected RGB LEDs; and
2. the power input terminal of the LED driver IC.

In this way the LED driver IC is adapted for supplying electrical power to series connected RGB LEDs at a voltage which is:

1. greater than a voltage at which the LED driver IC receives electrical power from the energy source; and
2. only that required for operating those series connectible RGB LEDs which are not being shorted across by various LED switches included in the LED driver IC.

These and other features, objects and advantages will be understood or apparent to those of ordinary skill in the art from the following detailed description of the preferred embodiment as illustrated in the various drawing figures.

DETAILED DESCRIPTION

The present invention exploits the fact that power dissipated respectively in individual RGB LEDs 84, 94, 104 controls color and brightness of light emitted respectively from each of the LEDs. That is, not current flowing through a LED and not voltage applied across a LED, but a product of current times voltage, i.e. power, over a certain interval of time determines the color and brightness of light emitted from the individual RGB LEDs 84, 94, 104.

Figure 5:
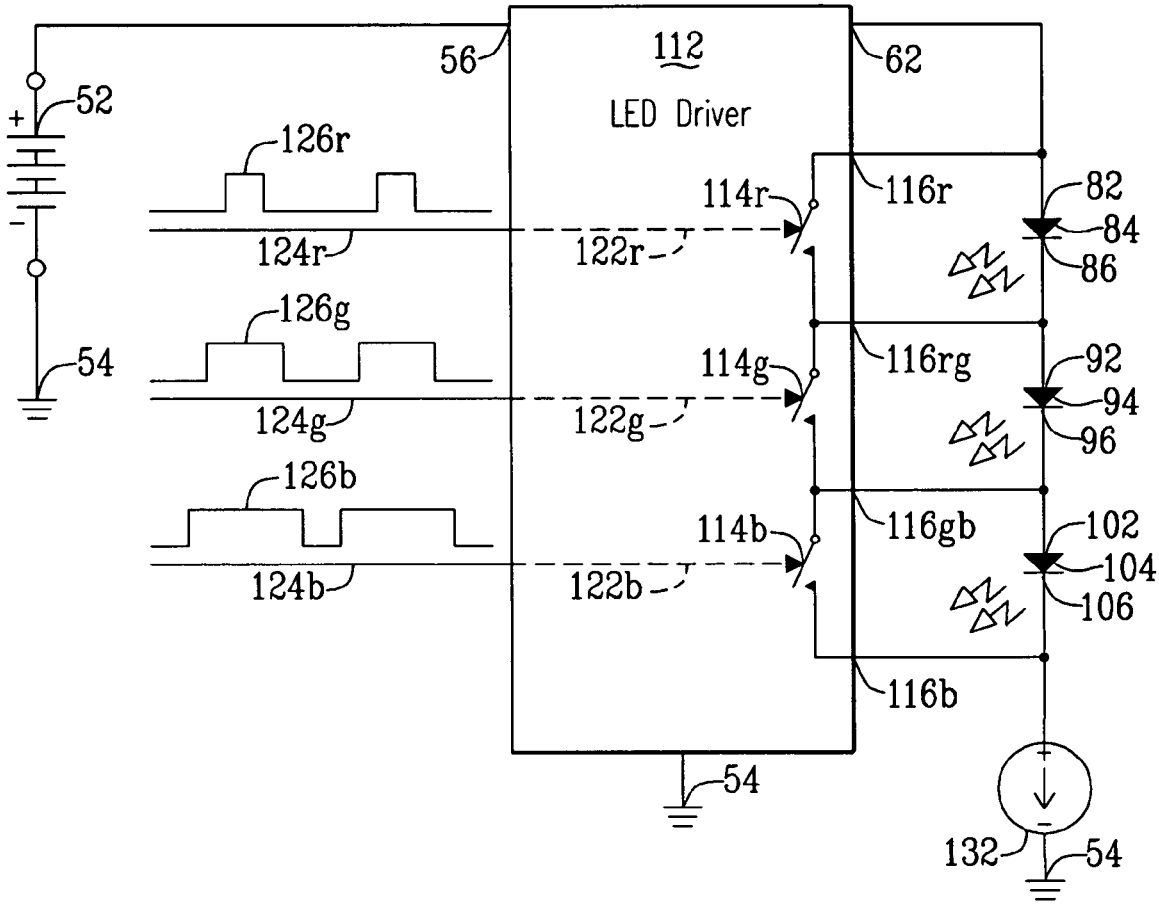
FIG. 5 is a circuit diagram depicting a LED driver in accordance with the present disclosure connected to series connected RGB LEDs for controlling the operation thereof.

As depicted in FIG. 5, RGB LEDs 84, 94, 104 energized in accordance with the present disclosure are connected in series to reduce power loss. To allow differing power dissipation in each of the RGB LEDs 84, 94, 104 over a certain interval of time, a LED driver 112 in accordance with the present disclosure, preferably an IC, includes three (3) LED switches 114*r*, 114*g*, 114*b*. The LED switches 114*r*, 114*g*, 114*b* connect respectively in parallel with each of the RGB LEDs 84, 94, 104 via output terminals 116*r*, 116*rg*, 116*gb*, 116*b* of the LED driver 112. As indicated by dashed lines 122*r*, 122*g*, 122*b*, operation the LED switches 114*r*, 114*g*, 114*b* is independently controlled by binary digital switching signals 124*r*, 124*g*, 124*b* supplied to the LED driver 112. When individual switching signals 124*r*, 124*g*, 124*b* are in one binary state, the corresponding LED switches 114*r*, 114*g*, 114*b* is open. When individual switching signals 124*r*, 124*g*, 124*b* are in the other binary state, the corresponding LED switches 114*r*, 114*g*, 114*b* is closed.

Responsive to the switching signals 124*r*, 124*g*, 124*b*, the LED switches 114*r*, 114*g*, 114*b* operate repetitively to open and close in a pulsed mode with the same low repetition rate which, however, is sufficiently fast to avoid ocularly perceptible flicker in light emitted from the RGB LEDs 84, 94, 104, preferably 1 Khz. When individual LED switches 114*r*, 114*g*, 114*b* open, they permits electrical current to flow through the RGB LEDs 84, 94, 104 to which the LED switches 114*r*, 114*g*, 114*b* connects. When individual LED switches 114*r*, 114*g*, 114*b* close, they respectively short across and thereby shunt current around their corresponding RGB LEDs 84, 94, 104. Arranged in this way with the switching signals 124*r*, 124*g*, 124*b* respectively controlling the operation of the LED switches 114*r*, 114*g*, 114*b*, individual RGB LEDs 84, 94, 104 may have differing duty cycles similar to or the same as those indicated by typical switching signal waveforms 126*r*, 126*g*, 126*b* illustrated in FIG. 5 for the switching signals 124*r*, 124*g*, 124*b*.

A circuit in accordance with the present disclosure also replaces the ballast resistor 74 with a unique DC current generator 132 connected in series between the green LED 104 and circuit ground 54. While in the illustration of FIG. 5 the DC current generator 132 is depicted separate from the LED driver 112, in accordance with the present disclosure the DC current generator 132 may, in fact, be incorporated into an IC LED driver 112.

The DC current generator 132 adjusts the overall brightness of the three (3) RGB LEDs 84, 94, 104 by controlling the amount of current, $I_{LED}$, flowing through the series connected RGB LEDs 84, 94, 104 when the LED switches 114*r*, 114*g*, 114*b* respectively connected in parallel therewith are open. Depending upon the duty cycle controlled by the waveforms 126*r*, 126*g*, 126*b* of the switching signals 124*r*, 124*g*, 124*b*, a certain RMS current, respectively $i_R$, $i_G$ and $i_B$, flows through each of the RGB LEDs 84, 94, 104.

$$i_R = d_R \times i_{LED}$$

$$i_G = d_G \times i_{LED}$$

$$i_B = d_B \times i_{LED}$$

Where $d_R$, $d_G$ and $d_B$ are the duty cycles respectively of the RGB LEDs 84, 94, 104.

In this way, each of the series connected RGB LEDs 84, 94, 104 dissipates different amounts of power depending upon the duty cycles, $d_R$, $d_G$ and $d_B$, of the LED switches 114*r*, 114*g*, 114*b*. Differing combinations of duty cycles, $d_R$, $d_G$ and $d_B$, for the three (3) LED switches 114*r*, 114*g*, 114*b* cause the combined RGB LEDs 84, 94, 104 to emit different colors of light. Overall, a range of different colors of light, and in particular, white light will be easily produced by three (3) RGB LEDs 84, 94, 104 operating in this way.

Figure 6:
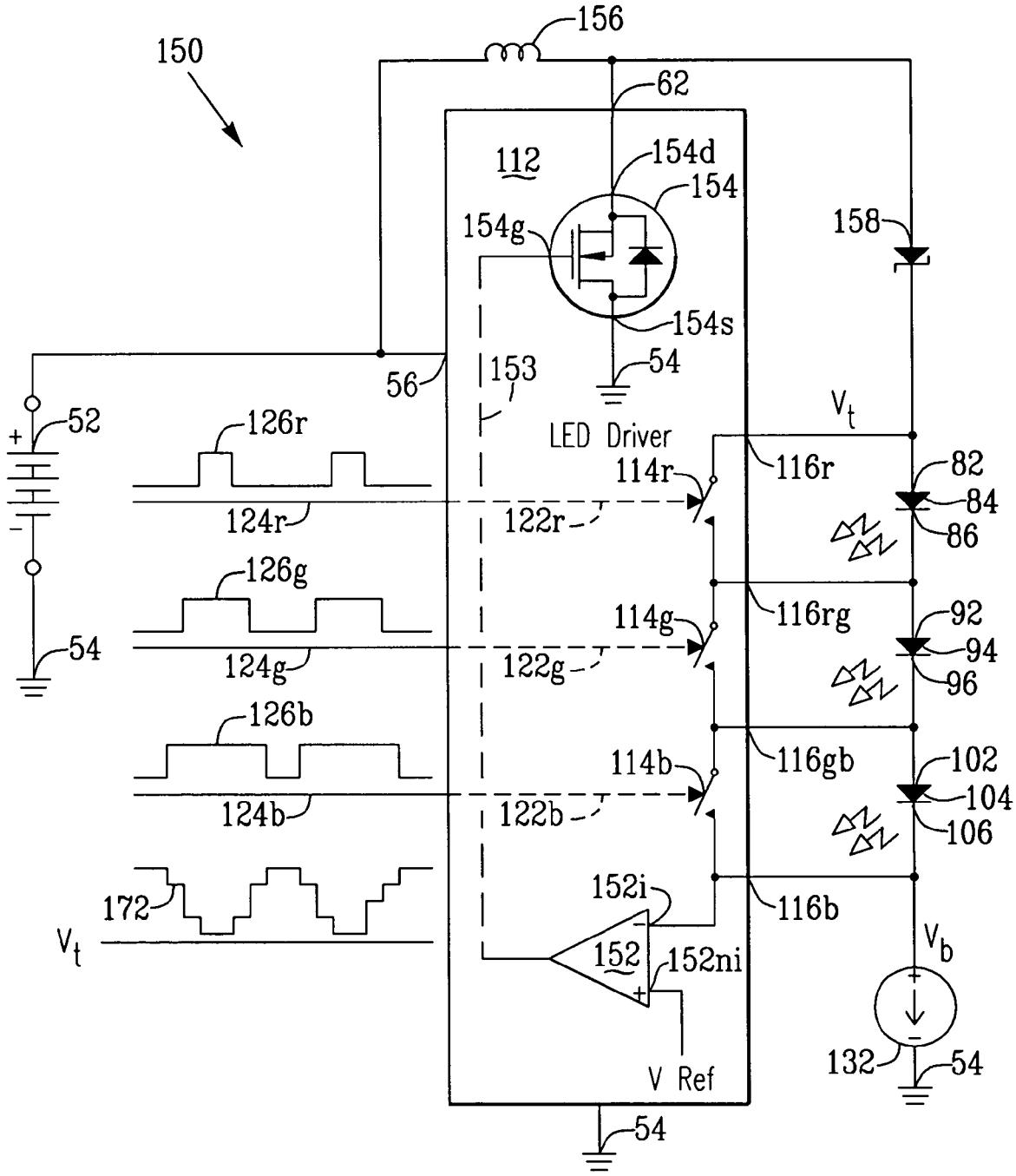
FIG. 6 is a circuit diagram depicting an adaptive boost converter for controlling the operation of series connected RGB LEDs, and for energizing the operation thereof with proper power at minimum cost.

However, energy efficiency of the LED driver 112 such as that illustrated in FIG. 5 may be further increased by a special LED driver circuit such as that depicted in FIG. 6. Serial connection of RGB LEDs 84, 94, 104 requires that battery voltage, e.g. 1.5v to 4.2v, be increased (boosted) to at least 10v for only series connected RGB LEDs 84, 94, 104, or to at least 16v for 4 LEDs, e.g. a WLED 66 connected in series with series connected RGB LEDs 84, 94, 104. A circuit called a charge pump or a circuit called a boost converter, i.e. a so called DC to DC boost converter, can provide the higher voltage required for either of the two preceding series connected combinations of LEDs, or other series connected combinations of LEDs.

The preferred circuit for increasing voltage applied to series connected LEDs depicted in FIG. 6 employs an adaptive boost converter identified by the general reference character 150. The LED driver 112 of the adaptive boost converter includes a comparator 152 having an inverting input 152*i* which connects to the output terminal 116*b*. A reference voltage $V_{Ref}$ is applied to a non-inverting input 152*ni* of the comparator 152. Connected in this way the comparator 152 senses the voltage present across the DC current generator 132, i.e. $V_b$, and compares the voltage $V_b$ with the reference voltage $V_{Ref}$. An output signal from the comparator 152, indicated in FIG. 6 by a dashed line 153, controls the operation of a voltage-boost switch 154 which for the polarity of the battery 52 illustrated in FIG. 6 is preferably a N-type MOSFET. Accordingly, the output of the comparator 152 is coupled to a gate terminal 154*g* of the voltage-boost switch 154 while a source terminal 154*s* connects to circuit ground 54 and a drain terminal 154*d*, which is an output terminal of the voltage-boost switch 154, connects to the LED power output terminal 62 of the LED driver 112. Lastly, an inductor 156 connects between the power input terminal 56 and the LED power output terminal 62 of the LED driver 112 while a Schottky diode 158 connects between the LED power output terminal 62 and the output terminal 116*r*.

Operation of the adaptive boost converter provides a voltage, $V_t$, at the output terminal 116*r* which is applied across the series connected RGB LEDs 84, 94, 104 and the DC current generator 132. However, the voltage $V_t$ is not fixed at a particular value, e.g. 10v. Rather, the adaptive boost converter always produces at least a minimum voltage $V_t$ across the series connected RGB LEDs 84, 94, 104 and the DC current generator 132 which equals or exceeds a minimum bias voltage, e.g. 0.4v, required for proper operation of the DC current generator 132. In this way the adaptive boost converter ensures that the DC current generator 132 always functions properly. As the switching signals 124*r*, 124*g*, 124*b* change, the voltage $V_t$ produced by the adaptive boost converter continuously changes responsive to the state of the LED switches 114*r*, 114*g*, 114*b*, and at the same low repetition rate used for triggering the LED switches 114*r*, 114*g*, 114*b*. Whenever one of the LED switches 114*r*, 114*g*, 114*b* closes, the voltage $V_t$ drops to a voltage required to energize only those of the RGB LEDs 84, 94, 104 whose LED switches 114*r*, 114*g*, 114*b* remain open. Whenever one of the LED switches 114*r*, 114*g*, 114*b* opens, the voltage $V_t$ increases to that required to energize those of the RGB LEDs 84, 94, 104 whose LED switches 114*r*, 114*g*, 114*b* which are then open. Operating in this way, the voltage $V_t$ exhibits a waveform 172 such as that depicted in FIG. 6 for switching signal waveforms 126*r*, 126*g*, 126*b* depicted in that FIG. In this way the adaptive boost converter ensures that the voltage $V_t$ applied across the series connected RGB LEDs 84, 94, 104 and the DC current generator 132 is only that required for those LEDs which are then being energized plus the bias voltage required to ensure proper operation of the DC current generator 132. In this way the adaptive boost converter depicted in FIG. 6 provides maximum efficiency control of the RGB LEDs 84, 94, 104, and therefore lengthens battery life.

Figure 7:
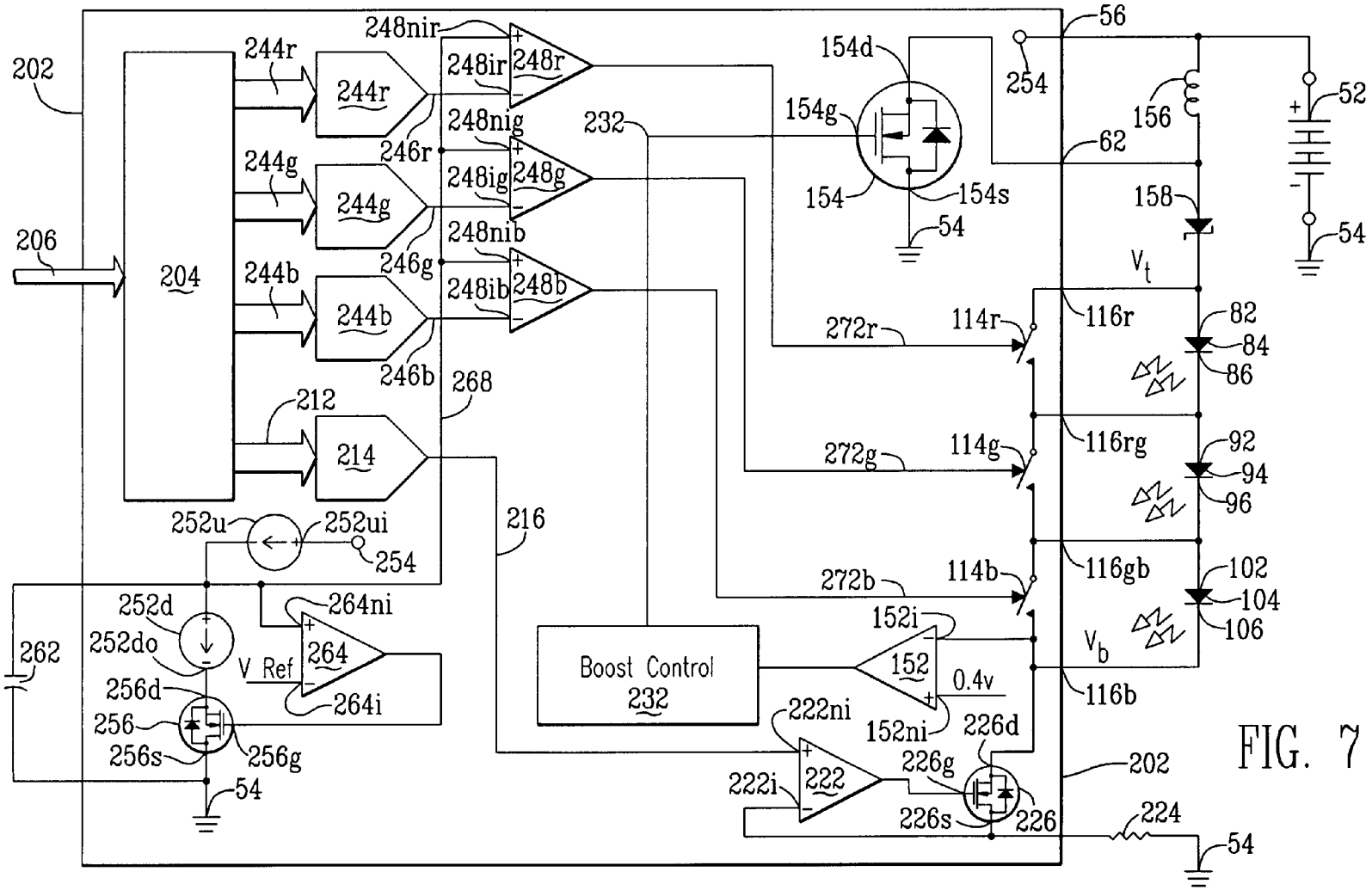
FIG. 7 is a block diagram depicting an IC which implements the adaptive boost converter illustrated in FIG. 6.

FIG. 7 depicts a block diagram for an RGB LED driver IC 202 that implements the adaptive boost converter illustrated in FIG. 6. The RGB LED driver IC 202 includes a serial digital interface 204 which exchanges data with a serial digital data bus 206. The serial digital data bus 206 may be the same as or similar to Phillips' $I^2C$ bus as described in U.S. Pat. No. 4,689,740, or any other analogous digital data bus adapted for serial data communication. The serial digital interface 204 stores digital data received via the serial digital data bus 206 which specifies relative proportions of light to be produced respectively by the RGB LEDs 84, 94, 104, and overall brightness of light produced by the three (3) RGB LEDs 84, 94, 104.

Figure 1:
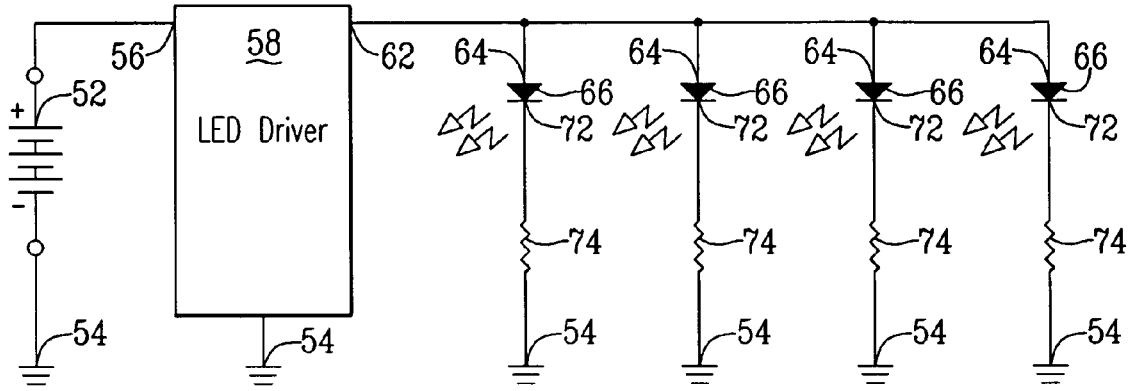
FIG. 1 (Prior Art)
FIG. 1 is a circuit diagram depicting a typical prior art configuration for energizing the operation of WLEDs connected in parallel.
Figure 2:
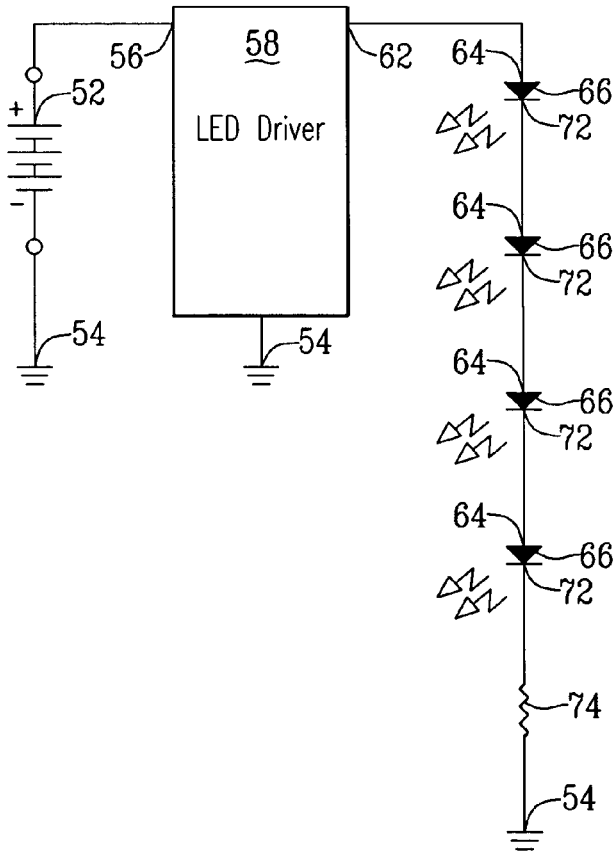
FIG. 2 (Prior Art)
FIG. 2 is a circuit diagram depicting a typical prior art configuration for energizing the operation of series connected WLEDs.
Figure 3:
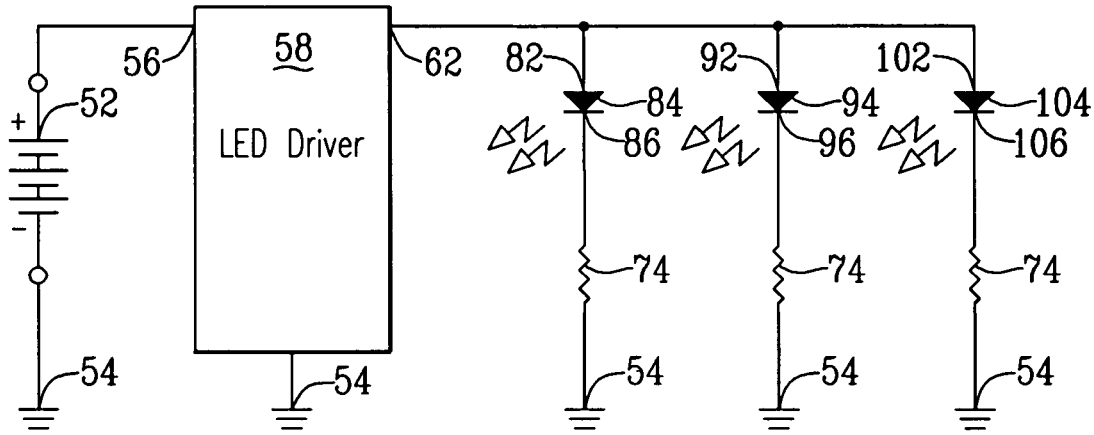
FIG. 3 (Prior Art)
FIG. 3 is a circuit diagram depicting a typical prior art configuration for energizing the operation of RGB LEDs connected in parallel.
Figure 4:
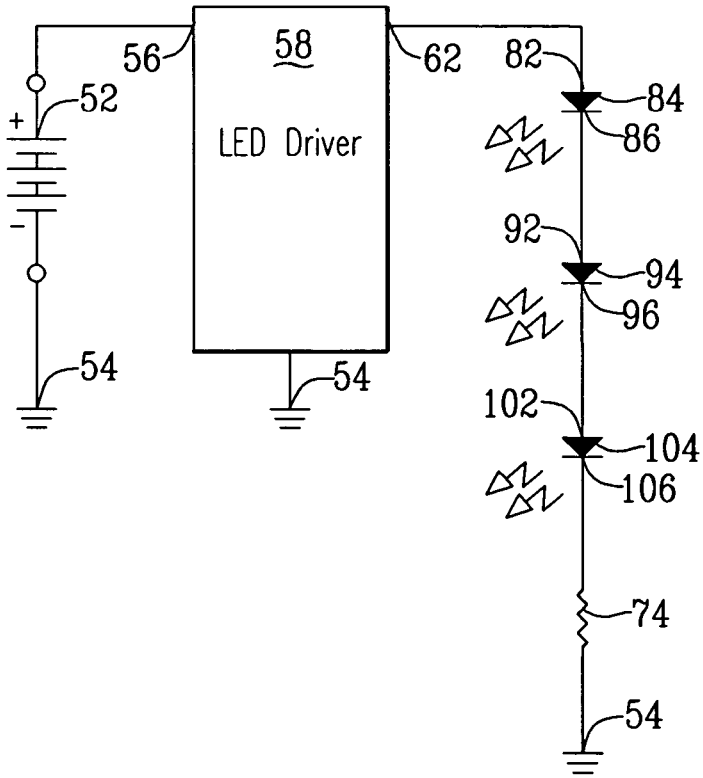
FIG. 4 (Prior Art)
FIG. 4 is a circuit diagram depicting a typical prior art configuration for energizing the operation of series connected RGB LEDs.

To control the overall brightness of the three (3) RGB LEDs 84, 94, 104, the serial digital interface 204 transmits brightness digital data via a brightness bus 212 to a brightness digital-to-analog converter ("DAC") 214. The brightness DAC 214, responsive to the brightness data, produces a brightness analog signal transmitted from an output of the brightness DAC 214 via a brightness signal line 218 to a non-inverting input 222*ni* of a comparator 222. An inverting input 222*i* of the comparator 222, which forms part of the DC current generator 132 depicted in FIGS. 4 and 6, connects to one terminal of a current sensing resistor 224 which is outside the RGB LED driver IC 202. The other terminal of the current sensing resistor 224 connects to circuit ground 54. To minimize power loss as much as practicable, the resistance of the current sensing resistor 224 is made small so the voltage across the current sensing resistor 224 when the RGB LEDs 84, 94, 104 are operating is around 0.1v. An output of the comparator 222 connects to a gate terminal 226*g* of an N-type MOSFET 226 which also forms part of the DC current generator 132. A drain terminal 226*d* of the N-type MOSFET 226 connects to the output terminal 116*b* while a source terminal 226*s* connects to a juncture between the inverting input 222*i* of the comparator 222 and the current sensing resistor 224.

Within the RGB LED driver IC 202, an output of the comparator 152 supplies a comparator output signal to a boost control circuit 232. The boost control circuit 232 produces a digital pulse width modulated ("PWM") boost control signal which is supplied to the gate terminal 154*g* of the voltage-boost switch 154 via a boost control signal line 234. The boost control signal which the gate terminal 154*g* receives from the boost control circuit 232 repetitively turns the voltage-boost switch 154 on and off. The PWM boost control signal repetitively turns the voltage-boost switch 154 on and off at a frequency which is significantly higher than the 1.0 Khz repetition rate for controlling the operation of the LED switches 114*r*, 114*g*, 114*b*, e.g. 1.0 Mhz. The RGB LED driver IC 202 includes high power P-type MOSFET switches for the LED switches 114*r*, 114*g*, 114*b*. Configured in this way brightness data stored in the serial digital interface 204 controls the amount of current which flows through the series connected RGB LEDs 84, 94, 104 when all of the LED switches 114*r*, 114*g*, 114*b* are open, i.e controls overall brightness of light produced by the three (3) RGB LEDs 84, 94, 104.

To control relative proportions of light to be produced respectively by the RGB LEDs 84, 94, 104, the serial digital interface 204 transmits RGB digital data respectively via RGB buses 242*r*, 242*g*, 242*b* respectively to a switch control R-DAC 244*r*, to a switch control G-DAC 244*g*, and to a switch control B-DAC 244*b*. Analog LED-control output-signals produce respectively by the R-DAC 244*r*, G-DAC 244*g* and B-DAC 244*b* are transmitted via RGB signal lines 246*r*, 246*g*, 246*b* respectively to inverting inputs 248*ir*, 248*ig*, 248*ib* of switch control comparators 248*r*, 248*g* and 248*b*. The RGB LED driver IC 202 supplies a signal having a triangular waveform in parallel to non-inverting inputs 248*nir*, 248*nig*, 248*nib* of the switch control comparators 248*r*, 248*g* and 248*b*. The triangular-waveform signal has a frequency which equals the 1.0 Khz repetition rate for signals which control the operation of the LED switches 114*r*, 114*g*, 114*b*, such as the waveforms 126*r*, 126*g*, 126*b* depicted in FIGS. 5 and 6.

To produce the signal having a triangular waveform supplied in parallel to the non-inverting inputs 248*nir*, 248*nig*, 248*nib* of the switch control comparators 248*r*, 248*g* and 248*b*, the RGB LED driver IC 202 includes two series connected current generators 252*u* and 252*d*. An input 252*ui* of the current generator 252*u* connects to an internal power terminal 254 of the RGB LED driver IC 202. An output 252*do* of the current generator 252*d* connects to a drain terminal 256*d* of a N-type MOSFET 256 included in the triangular waveform generator. A source terminal 256*s* of the N-type MOSFET 256 connects to circuit ground 54. The current generators 252*u* and 252*d* are constructed so that twice as much current, i.e. $2\times i_o$, flows through the current generator 252*d* when the N-type MOSFET 256 is turned-on as flows continuously through the current generator 252*d*.

One terminal of a capacitor 262, that is located outside the RGB LED driver IC 202, connects to a juncture between the current generators 252u and 252*d* while a second terminal of the capacitor 262 connects to circuit ground 54. The triangular waveform generator of the RGB LED driver IC 202 also includes a comparator 264 having a non-inverting input 264*ni* that also connects to the juncture between the current generators 252*u* and 252*d*. The RGB LED driver IC 202 supplies a reference voltage, i.e. $V_{Ref}$, to an inverting input 264*i* of the comparator 264. An output of the comparator 264 connects to a gate terminal 256*g* of the N-type MOSFET 256. A triangular-waveform signal line 268 connects the juncture between the current generators 252*u* and 252*d* to the non-inverting inputs 248*nir*, 248*nig*, 248*nib* of the switch control comparators 248*r*, 248*g* and 248*b*.

While the output signal from the comparator 264 keeps the N-type MOSFET 256 turned-off, current from the current generator 252*u* flows mainly into the capacitor 262 thereby continuously increasing the voltage supplied via the triangular-waveform signal line 268 to the non-inverting inputs 248*nir*, 248*nig*, 248*nib* of the switch control comparators 248*r*, 248*g* and 248*b*. When the voltage across the capacitor 262 exceeds the reference voltage, $V_{Ref}$, the comparator 264 switches and its output signal turns the N-type MOSFET 256 on. Turning the N-type MOSFET 256 on causes twice as much current to flow from the juncture between the current generators 252*u* and 252*d* as the current generator 252*u* supplies thereto. Consequently, while the N-type MOSFET 256 is turned-on the voltage across the capacitor 262 that is present on the triangular-waveform signal line 268 decreases continuously until the comparator 264 again switches and its output signal turns the N-type MOSFET 256 off. Hysteresis in the operation of the comparator 264 determines the amplitude of the signal having a triangular waveform that the triangular waveform generator of the RGB LED driver IC 202 supplies to the non-inverting inputs 248*nir*, 248*nig*, 248*nib* of the switch control comparators 248*r*, 248*g* and 248*b* via the triangular-waveform signal line 268. The capacitance of the capacitor 262 determines the frequency of the triangular-waveform signal, preferably about 1 Khz.

Responsive to one of the analog LED-control output-signals produced respectively by one of the R-DAC 244*r*, G-DAC 244*g* and B-DAC 244*b* and to the triangular-waveform signal, the switch control comparators 248*r*, 248*g* and 248*b* respectively produce a digital switch-control output-signal. Within the RGB LED driver IC 202, RGB switch control signal lines 272*r*, 272*g*, 272*b* couple the digital switch-control output-signal produced respectively by the switch control comparators 248*r*, 248*g* and 248*b* to the high power P-type MOSFET switches which provide the LED switches 114*r*, 114*g*, 114*b* of the RGB LED driver IC 202.

In this way, responsive to data stored in the serial digital interface 204, output signals from the switch control comparators 248*r*, 248*g* and 248*b* turn the LED switches 114*r*, 114*g*, 114*b* on and off at a repetition rate which is the same as the frequency of the triangular waveform signal. The data stored in the serial digital interface 204 determines a duration during which each of the LED switches 114*r*, 114*g*, 114*b* is respectively turned-on during each cycle of the triangular waveform, i.e. determines the relative proportion of light to be produced respectively by each of the RGB LEDs 84, 94, 104.

Although the present invention has been described in terms of the presently preferred embodiment, it is to be understood that such disclosure is purely illustrative and is not to be interpreted as limiting. While the switching signal waveforms 126*r*, 126*g*, 126*b* depicted in FIGS. 5 and 6 having fixed time intervals permit the RGB LEDs 84, 94, 104 to produce a fixed but large number of different colors of light, pulse width modulation ("PWM") of the switching signal waveforms 126*r*, 126*g*, 126*b* permits producing a continuous spectrum in the color of light emitted by the RGB LEDs 84, 94, 104. Consequently, without departing from the spirit and scope of the disclosure, various alterations, modifications, and/or alternative applications will, no doubt, be suggested to those skilled in the art after having read the preceding disclosure. Accordingly, it is intended that the following claims be interpreted as encompassing all alterations, modifications, or alternative applications as fall within the true spirit and scope of the disclosure including equivalents thereof. In effecting the preceding intent, the following claims shall:

1. not invoke paragraph 6 of 35 U.S.C. § 112 as it exists on the date of filing hereof unless the phrase "means for" appears expressly in the claim's text;
2. omit all elements, steps, or functions not expressly appearing therein unless the element, step or function is expressly described as "essential" or "critical;"
3. not be limited by any other aspect of the present disclosure which does not appear explicitly in the claim's text unless the element, step or function is expressly described as "essential" or "critical;" and
4. when including the transition word "comprises" or "comprising" or any variation thereof, encompass a non-exclusive inclusion, such that a claim which encompasses a process, method, article, or apparatus that comprises a list of steps or elements includes not only those steps or elements but may include other steps or elements not expressly or inherently included in the claim's text.

What is claimed is:

1. An adaptive boost converter adapted for supplying electrical current to a number of series connected RGB LEDs for energizing the operation thereof, the series connected RGB LEDs being connectible in series with a current generator, the adaptive boost converter comprising:

a. a power input terminal for receiving electrical power from an energy source;

b. a plurality of LED switches equal in number to the number of series connected RGB LEDs, each LED switch:

i. being connectible across one of the RGB LEDs; and ii. operating responsive to a binary digital switching signal so that the LED switch:

1) when open permits electrical current to flow through the RGB LED across which the LED switch is connectible; and 2) when closed shorts across and thereby shunts current around the RGB LED across which the LED switch is connectible;

c. a comparator connectible to the current generator for sensing voltage across the current generator; and d. a voltage boosting circuit for increasing voltage of electrical power received from the energy source to a higher voltage to be applied across series connectible RGB LEDs and series connectible current generator, the voltage applied across series connected RGB LEDs and series connectible current generator varying responsive to an output signal produced by the comparator;

whereby the voltage appliable across series connectible RGB LEDs and series connectible current generator is only that required by those series connectible RGB LEDs whose operation is then being energized by the adaptive boost converter plus a bias voltage required to ensure proper operation of the current generator.

2. The adaptive boost converter of claim 1 wherein the plurality of LED switches and the comparator are included in an IC.

3. The adaptive boost converter of claim 2 wherein the IC further comprises a current generator that is adapted for being connected in series with series connected RGB LEDs.

4. The adaptive boost converter of claim 1 wherein the voltage boosting circuit is a DC to DC boost converter.

5. The adaptive boost converter of claim 1 wherein the voltage boosting circuit is a charge pump.

6. A LED driver IC adapted for:

a. supplying electrical current to a number of series connected RGB LEDs for energizing operation thereof; and b. controlling operation of those series connected RGB LEDs;

the LED driver IC comprising:

a. a power input terminal for receiving electrical power from an energy source;

b. a plurality of LED switches equal in number to the number of series connected RGB LEDs, each LED switch:

i. being connectible across one of the RGB LEDs; and ii. operating responsive to a binary digital switching signal:

1) so that the LED switch:

a) when open permits electrical current to flow through the RGB LED across which the LED switch is connectible; and b) when closed shorts across and thereby shunts current around the RGB LED across which the LED switch is connectible; and 2) having a repetition rate which fast enough to avoid ocularly perceptible flicker in light producible by series connected RGB LEDs that are connectible to the LED driver IC;

c. a current generator that is connectible in series with series connected RGB LEDs;

d. a comparator connected to the current generator for:

i. sensing voltage across the current generator; and ii. producing a comparator output signal which responds to the voltage across the current generator;

e. a boost control circuit that:

i. receives the comparator output signal from the comparator; and ii. responsive to the comparator output signal generates a digital boost control signal which has a frequency significantly higher than the repetition rate of the binary digital switching signals for operating the LED switches; and f. a voltage-boost switch that:

i. receives the boost control signal from the boost control circuit;

ii. responsive to the boost control signal repetitively turns on and off at the frequency of the boost control signal; and iii. has a switch output terminal which is connectible to one terminal of an inductor, the inductor being connectible between:

1) series connected RGB LEDs; and 2) the power input terminal of the LED driver IC;

whereby the LED driver IC is adapted for supplying electrical power to series connected RGB LEDs and the current generator at a voltage which is:

a. greater than a voltage at which the LED driver IC receives electrical power from the energy source; and b. only that required for operating those series connectible RGB LEDs which are not being shorted across by a LED switch plus a bias voltage required to ensure proper operation of the current generator.

7. The LED driver IC of claim 6 wherein the boost control signal generated by the boost control circuit is pulse width modulated ("PWM").

8. The LED driver IC of claim 6 further comprising a digital interface which stores digital data that specifies:

a. relative proportions of light producible respectively by series connected RGB LEDs as are connectible to the LED driver IC; and b. overall brightness of light producible by such series connected RGB LEDs as are connectible to the LED driver IC.

9. The LED driver IC of claim 8 wherein the digital interface receives via a serial digital data bus the digital data specifying:

a. relative proportions of light producible respectively by series connected RGB LEDs as are connectible to the LED driver IC; and b. overall brightness of light producible by such series connected RGB LEDs as are connectible to the LED driver IC.

10. The LED driver IC of claim 8 further comprising:

g. a brightness digital-to-analog converter ("DAC") which:

i. receives from the digital interface digital data specifying overall brightness of light produced by such series connected RGB LEDs as are connectible to the LED driver IC; and ii. produces responsive to the received digital data a brightness analog signal which is coupled to the current generator for controlling how much electrical current flows through series connected RGB LEDs as are connectible to the LED driver IC when all of the LED switches are open;

whereby the LED driver IC is adapted for controlling overall brightness of light producible by series connected RGB LEDs as are connectible across the LED switches of the LED driver IC.

11. The LED driver IC of claim 8 further comprising:

g. a plurality of switch-controlling DACs which equal in number the number of LED switches included in the LED driver IC, each of the switch-controlling DACs respectively:

i. receiving from the digital interface digital data specifying a relative proportion of light to be produced by one of the series connected RGB LEDs as are connectible across the LED switches of the LED driver IC; and ii. producing responsive to the received digital data an analog LED-control output-signal;

h. a plurality of switch control comparators which equal in number the number of LED switches included in the LED driver IC, each switch control comparator respectively:

i. receiving:

1) at an inverting input of the switch control comparator a LED-control output-signal produced by one of the switch-controlling DACs; and 2) at a non-inverting input of the switch control comparator a triangular-waveform signal that is generated within the LED driver IC; and ii. producing responsive both to the LED-control output-signal and to the triangular-waveform signal the binary digital switching signal:

1) which is coupled to one of the LED switches included in the LED driver IC; and 2) to which the LED switch responds by opening and closing the LED switch;

whereby the LED driver IC is adapted for controlling relative proportions of light producible by series connected RGB LEDs as are connectible across the LED switches of the LED driver IC.

* * * * *

UNITED STATES PATENT AND TRADEMARK OFFICE

CERTIFICATE OF CORRECTION

PATENT NO. : 7,633,463 B2
APPLICATION NO. : 11/116724
DATED : December 15, 2009
INVENTOR(S) : Sorin Laurentiu Negru It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1045 days.

Signed and Sealed this

Ninth Day of November, 2010

David J. Kappos

David J. Kappos
*Director of the United States Patent and Trademark Office*